US008789214B2

(12) United States Patent
Keller

(10) Patent No.: US 8,789,214 B2
(45) Date of Patent: Jul. 29, 2014

(54) METHOD AND DEVICE FOR DETERMINING MAINTENANCE INTERVALS

(75) Inventor: Hans Keller, Dürnten (CH)

(73) Assignee: Enswico IP AG, Sarnen (CH)

( * ) Notice: Subject to any disclaimer, the term of this patent is extended or adjusted under 35 U.S.C. 154(b) by 698 days.

(21) Appl. No.: 12/675,704

(22) PCT Filed: May 23, 2008

(86) PCT No.: PCT/CH2008/000234

§ 371 (c)(1),
(2), (4) Date: Mar. 8, 2010

(87) PCT Pub. No.: WO2009/026733

PCT Pub. Date: Mar. 5, 2009

(65) Prior Publication Data

US 2011/0016619 A1 Jan. 27, 2011

(30) Foreign Application Priority Data

Aug. 29, 2007 (CH) ..... 1365/07

(51) Int. Cl.
*E03D 9/02* (2006.01)
*E03D 9/00* (2006.01)
*E03D 13/00* (2006.01)

(52) U.S. Cl.
CPC ..... *E03D 9/00* (2013.01); *E03D 13/005* (2013.01)
USPC ..... 4/222

(58) Field of Classification Search
CPC ..... E03D 2009/024
USPC ..... 4/222–233
IPC ..... E03D 9/00
See application file for complete search history.

(56) References Cited

U.S. PATENT DOCUMENTS

| | | | | |
|---|---|---|---|---|
| 3,867,101 | A * | 2/1975 | Herring | 422/119 |
| 4,253,950 | A * | 3/1981 | Wojtowicz | 210/696 |
| 4,587,069 | A * | 5/1986 | Meloy | 264/102 |
| 5,019,346 | A * | 5/1991 | Richter et al. | 422/28 |
| 5,489,415 | A * | 2/1996 | Van Vlahakis et al. | 422/264 |
| 2006/0236444 | A1 * | 10/2006 | Selover | 4/222 |
| 2011/0155934 | A1 * | 6/2011 | Guler et al. | 251/129.04 |

FOREIGN PATENT DOCUMENTS

| | | | |
|---|---|---|---|
| WO | WO 2007/064938 A2 | | 6/2007 |
| WO | WO2007064938 | * | 6/2007 |

* cited by examiner

*Primary Examiner* — Lori Baker
(74) *Attorney, Agent, or Firm* — Edwin D. Schindler

(57) ABSTRACT

A method for determining the point in time for the replacement of one or more of wearing parts, blocking fluids and fragrance and cleaning substances, dependent on the use of a sanitary apparatus, includes the step of placing an indicator element in the run-out region of the sanitary apparatus, which indicator element has an optically recognizable chemical or physical conversion indicator that provides an observable conversion after a predetermined, or pre-set, number of uses, or wettings, of the sanitary apparatus for altering maintenance personnel that maintenance of the sanitary apparatus is required. An apparatus for performing the method is also provided.

20 Claims, 5 Drawing Sheets

METHOD AND DEVICE FOR DETERMINING MAINTENANCE INTERVALS

BACKGROUND OF THE INVENTION

1. Technical Field of the Invention

Figure 1:
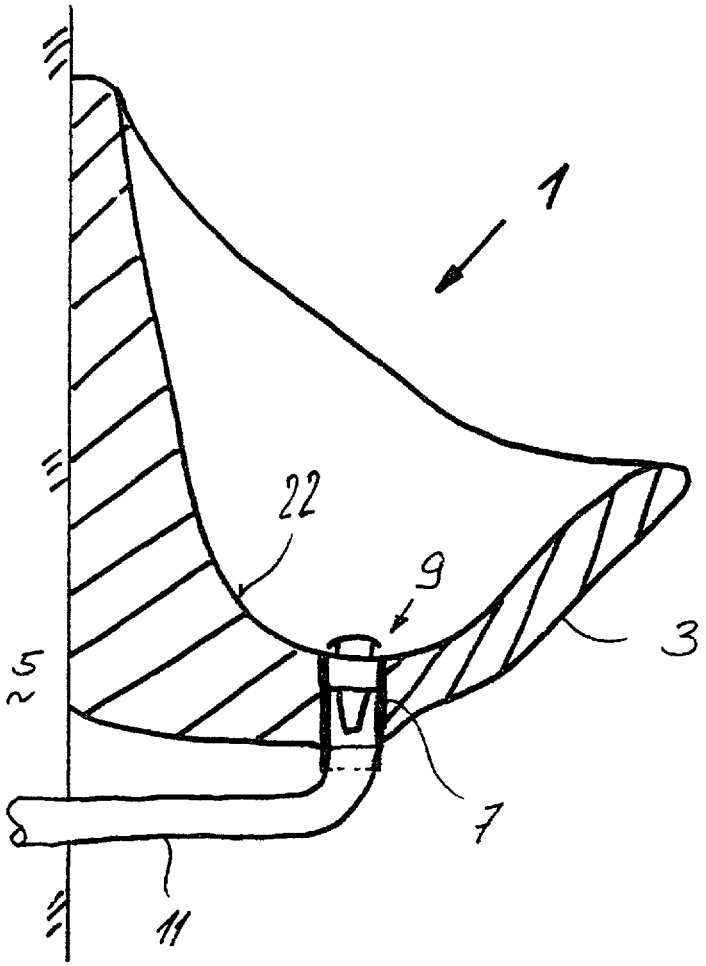

The subject matter of the invention is a method, and related apparatus, for determining the point in time for the replacement of wearing parts and/or of blocking fluid and/or fragrance substances and cleaning substances, in dependence on the use of a sanitary apparatus.

2. Description of the Prior Art

With sanitary apparatus, e.g. waterless urinals, it is necessary to exchange the blocking fluid and/or wearing parts in the region of the siphon at a suitable point in time, in order to avoid unpleasant odors. Today, this is effected either according to discretion or as a result of an unpleasant development of smell or in a fixed cycle. All criteria however are neither reliable nor meaningful, since in particular in larger toilet installations, a multitude of urinals are arranged next to one another and according to experience not all are used as equally as often. For this reason, with regard to the odor development, it is not possible to realize which of the urinal or urinals is, or are, releasing unpleasant odors. On the other hand, it makes no sense to prematurely exchange valve parts and siphon parts which are essentially still intact, with the less used urinals.

SUMMARY OF THE INVENTION

The object of the present invention is the provision of a method for determining the point in time for the replacement of wearing parts and/or blocking fluid and/or fragrance substances and cleaning substances, in dependence on the use of a sanitary apparatus, as well as the provision of a device for carrying out the method.

These objects are achieved by a method and related apparatus for determining the point in time for the replacement of one or more of wearing parts, blocking fluids and fragrance and cleaning substances, dependent on the use of a sanitary apparatus, that includes the step of placing an indicator element in the run-out region of the sanitary apparatus, which indicator element has an optically recognizable chemical or physical conversion indicator that provides an observable conversion after a predetermined, or pre-set, number of uses, or wettings, of the sanitary apparatus for altering maintenance personnel that maintenance of the sanitary apparatus is required.

By way of the physically and/or chemically attained visible change of an indicator element which is applied in the sanitary apparatus and which may be moistened with each use by way of fluid spray (urine), in the sole position and with a multitude of sanitary apparatus arranged next to one another, each individual one may be monitored, and the necessary actions may be carried out where necessary. This, on the one hand, with regard to odor emission, means an early recognition, i.e. before first indications may be smelt, and, on the other hand, a replacement may be applied with a low effort with regard to time and expense, only where this is also really necessary. By way of a suitable chemical and/or physical composition of the indicator element, fragrance substances may also be additionally added to this, said fragrance substances replacing those which are usually arranged on the walls of the sanitary rooms or are emitted by way of opening a door. Moreover, cleaning substances, such as bacteria, enzymes tensides etc., may also be added to the indicator element, which keep the sanitary apparatus clean and smellneural in a chemical and/or biological way, and furthermore permit a care and cleaning of the functioning elements in the valve region and siphon region, as well as the subsequent discharge tubes.

BRIEF DESCRIPTION OF THE DRAWING FIGURES

The invention is explained in more detail by way of one embodiment example of a unrinal.

Figure 2:
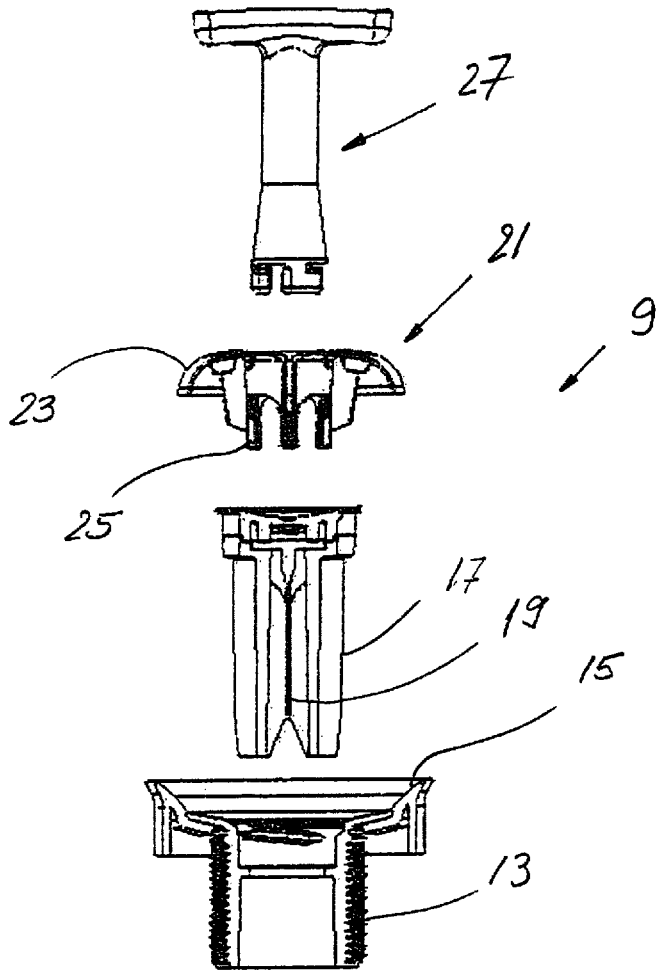
Figure 3:
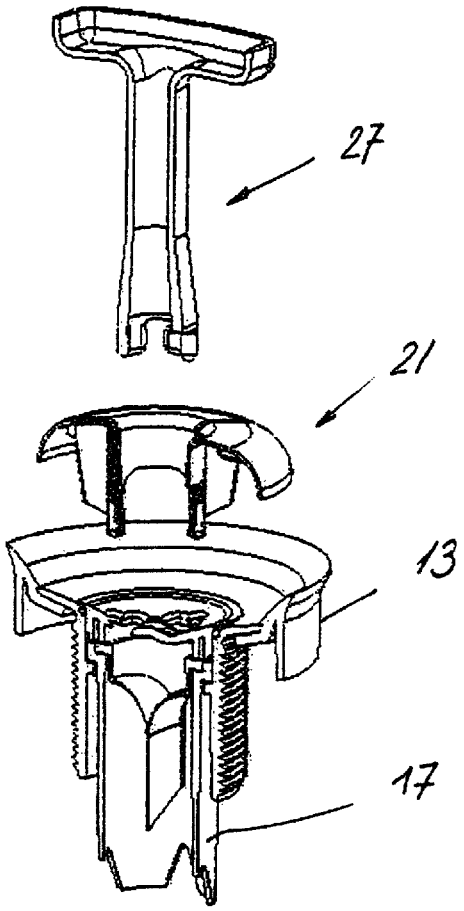
Figure 4:
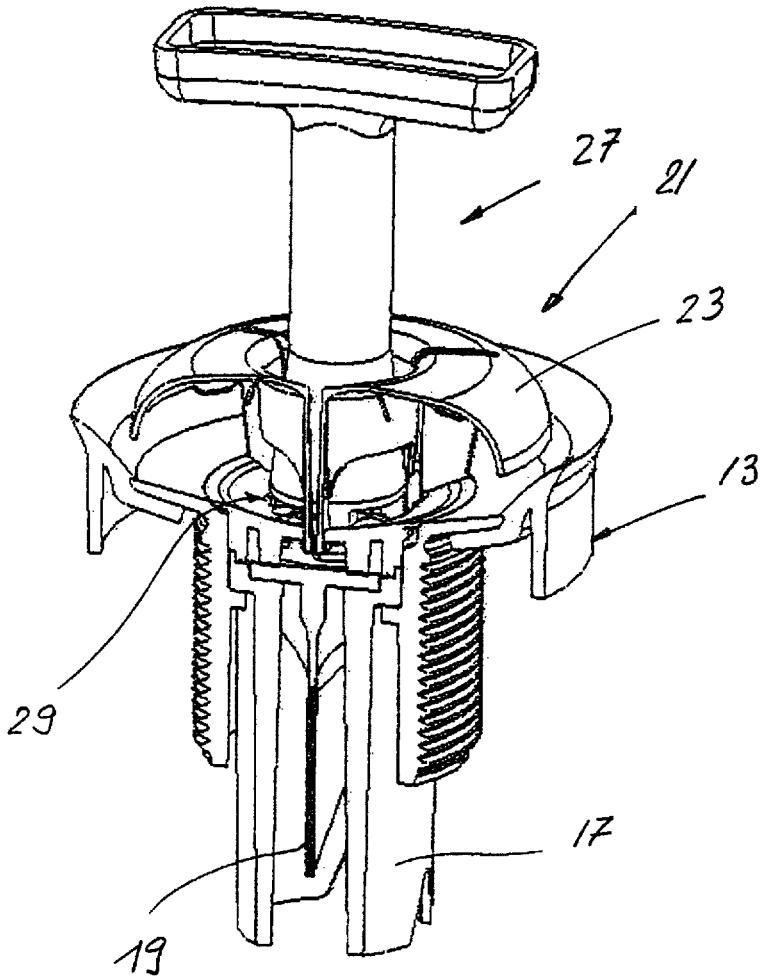
Figure 5:
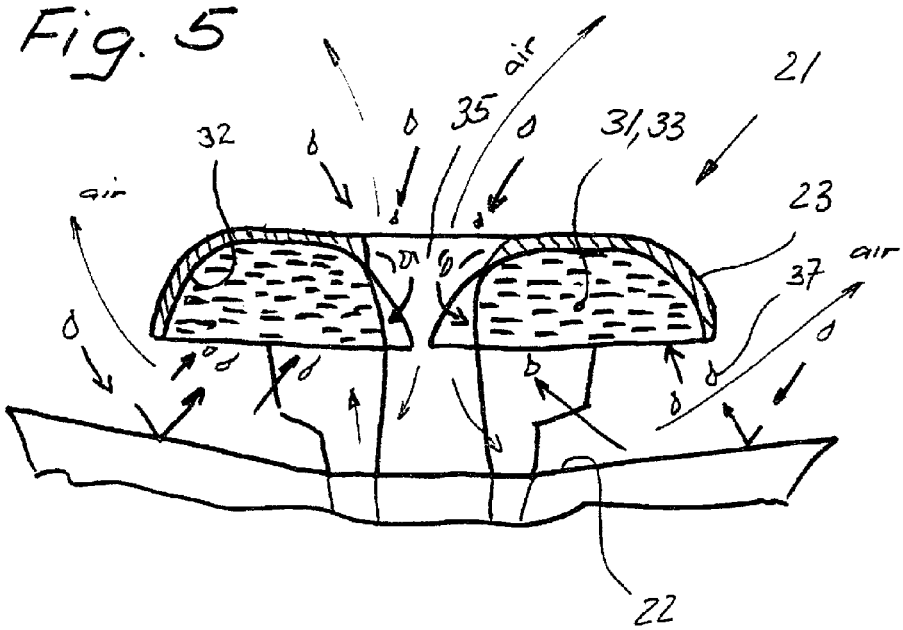

The drawing figures show an axial section through the device which drawing figures are:

FIG. 1 a vertical section through a waterless urinal,

FIG. 2 a longitudinal section through the elements of the valve of the waterless urinal, FIG. 3 a perspective longitudinal section through the partly assembled valve, FIG. 4 a vertical perspective longitudinal section through the assembled valve, and FIG. 5 a vertical section through the mushroom-like cap over the valve with a central and decentral opening.

DETAILED DESCRIPTION OF THE DRAWING FIGURES AND PREFERRED EMBODIMENTS

The urinal 1 which is shown schematically in FIG. 1 comprises a basin 3 with a base 22 which is directly or indirectly fastened on a wall 5. A valve 9 is inserted in a recess 7 on the base 22 of the basin 3. A discharge tube 11 (FIG. 1), which leads into the wall 5, on which the urinal 1 is fastened, connects to the tubular recess 7.

The individual parts of one possible design of a valve 9 are represented in FIG. 2. An adapter is indicated with the reference numeral 13, which may be inserted into the recess 7 of any urinal 1. The adapter 13 is inserted in a sealed manner in the discharge tube 11 by way of suitable sealing means which are not indicated in more detail. The adapter also bears sealingly on the recess 7, so that no urine may go downwards laterally of the run-in funnel 15. A valve 17 is screwed in the tubular inside of the adapter 13 or is held inserted by way of a bayonet-type closure. An odor-block 19 is inserted in the valve 17, as is, for example, described in WO 2004/059198. Of course, also a differently shaped odor-block, for example such as is described in WO 1999/57382, may be inserted. Alternatively, the odor-block may also be effected by way of a blocking fluid, as for example in the design described in CH 690917.

A cap 21 is arranged above the valve 17, which for example comprises a mushroom-like dome 23, on which feet 25 are integrally formed, with which the cap 21 may be fastened at a distance above the valve 17. Since all parts are manufactured of plastic, the connection between the cap 21 and the valve 17 may be effected by way of a snap mechanism, which is not shown in more detail. A key 27 is represented above the cap 21, with which key the valve 17 may be fastened in the adapter 17 and removed for exchange (FIGS. 2 and 3.) The key 27 is not part of the device.

In the sectioned representation according to FIG. 4, all elements are represented joined together and are connected to one another with the key 27 on the adapter 13. For a better overview, the space below the dome 23 is represented empty in this Figure. The dome 23 or the cap 21 protects the run-in region 29 of the valve 17 from blockage, for example due to cigarette butts, paper shreds etc. In the enlarged schematic representation of the cap 21 in FIG. 5, it is evident that according to the invention, the space 31 enclosed by the dome 23 is completely or partly filled with an indicator element 33.

The indicator element 33, which in a pasty, liquid or other form has been brought into the cap 21, apart from a forming matrix, comprises enzymes and/or tensides and/or bacteria and/or cleaning substances and/or dyes. These substances are moistened by urine droplets 37 which spray off with each use of the urinal 1. Thereby, the moistening is effected on the one hand from below by urine droplets 37 which come from the jet of urine which hits the base 22 of the urinal 1 outside the cap 21, and on the other hand by way of urine which, through a central opening 35 formed in the cap 21, if such is present, hits the base 22 and is partly reflected. The indicator element 33 is chemically/physically set in a manner such that after a predefined number of wettings, i.e., after a predetermined and set number of uses, of the urinal, i.e. by droplet-wise wetting, it is either completely decomposed and/or that it changes its color at least in the contact region with the dome 23, which has been manufactured from a transparent material. More particularly, the indicator element 33 is chemically/physically is set in a manner such that after a predetermined and set number of uses of the urinal, and not on the basis of its continued proper functionality or proper operation, it is either completely decomposed and/or it changes its color at least in the contact region with the dome 23. This change, be it by decomposition of the indicator or color change, is then visible from the outside without further aids. A maintenance team which periodically visits the urinal for cleaning and maintenance of the urinal 1, may then recognize without further ado, also from a larger number of urinals 1 arranged next to one another 1, as are set up for example in railway stations, in restaurants, airports etc., which of the valves 17 and/or indicator elements 33 need to be exchanged or where blocking fluid must be refilled. The life duration of the indicator element 33 is matched to a safe usage duration of the valve 17 or the blocking fluid, and ensures that the latter in this time period is not defect and thus fragrances may get into the sanitary room. Depending on the chemical composition of the indicator element 33, this apart from the cleaning substances which keeps the valve 17 clean from siltation, also contain enzymes and bacteria which permit a biological breakdown of urine siltation in the conduits and the prevent the buildup of urine scale, and specifically in the valve 17 as well as in the subsequent waste water conduits 11. Of course, a fragrance substance may also be added to the indicator element 33. This is dispensed depending on the user. A main component however is at all events a substance, which in the course of use, whose duration is defined, changes with regard to color.

Alternatively, the indicator element 33 may also consist of a border layer 32 of an indicator which is incorporated in the roof of the dome, and a mass arranged therebelow which may be broken down. The layer 32 which changes color thus comes into contact with the urine spray and urine droplets only when the decomposable indicator element 33 lying therebelow is decomposed. The indicator element 33 thus does not have to undergo a color change.

The invention claimed is:

1. A method for determining and fixing a time for replacing one or more of wearing parts, blocking fluid and a fragrance or cleaning substance used in a urinal apparatus, comprising the steps of:

providing an indicator element having an optically recognizable chemical or physical conversion indicator that is activated after a predetermined and set number of uses of a urinal apparatus and not on the basis of continued proper functionality of said urinal apparatus;

predetermining and setting the optically recognizable chemical or physical conversion indicator of the indicator element to be activated after the set number of uses, or wettings, of the urinal apparatus;

placing the indicator element in a run-out region of the urinal apparatus; and, replacing one or more of wearing parts, blocking fluid and a fragrance or cleaning substance used in the urinal apparatus when a conversion of the optically recognizable chemical or physical conversion occurs.

2. The method for determining and fixing a time for replacing one or more wearing parts, blocking fluid and a fragrance or cleaning substance used in a urinal a urinal apparatus according to claim 1, wherein the optically recognizable chemical or physical conversion of the indicator element results in, at least partially, a permanent change of color of the indicator element.

3. The method for determining and fixing a time for replacing one or more wearing parts, blocking fluid and a fragrance or cleaning substance used in a urinal apparatus according to claim 1, wherein the optically recognizable chemical or physical conversion of the indicator element results in, at least a partial, decomposition or dissolution of the indicator element.

4. The method for determining and fixing a time for replacing one or more wearing parts, blocking fluid and a fragrance or cleaning substance used in a urinal apparatus according to claim 1, further comprising the step of:

releasing one or more fragrant and cleaning substances by the indicator element when a conversion of the optically recognizable chemical or physical conversion occurs.

5. The method for determining and fixing a time for replacing one or more wearing parts, blocking fluid and a fragrance or cleaning substance used in a urinal apparatus according to claim 1, wherein said step of placing the indicator element in a run-out region of the urinal apparatus includes the sub-step of:

arranging the indicator element below a watertight, mushroom-shaped cap and at a vertical distance above a discharge opening in the urinal apparatus.

6. An apparatus for determining and fixing a time for replacing one or more wearing parts, blocking fluid and a fragrance or cleaning substance used in a urinal device, comprising:

an indicator element having an optically recognizable chemical or physical conversion indicator activated after a predetermined and set number of uses, or urine wettings, of a urinal device and not on the basis of continued proper functionality of said urinal device.

7. The apparatus for determining and fixing a time for replacing one or more wearing parts, blocking fluid and a fragrance or cleaning substance used in a urinal device according to claim 6, wherein said indicator element includes a paste settable in its degree of hardness.

8. The apparatus for determining and fixing a time for replacing one or more wearing parts, blocking fluid and a fragrance or cleaning substance used in a urinal device according to claim 6, wherein said indicator element includes a paste settable in its degree of decomposability.

9. The apparatus for determining and fixing a time for replacing one or more wearing parts, blocking fluid and a fragrance or cleaning substance used in a urinal device according to claim 6, wherein said indicator element includes a biologically degradable cleaning substance or dye for a use-dependent, self-activated cleaning of the urinal device.

10. The apparatus for determining and fixing a time for replacing one or more wearing parts, blocking fluid and a fragrance or cleaning substance used in a urinal device according to claim 9, wherein said biologically degradable cleaning substance is an enzyme.

11. The apparatus for determining and fixing a time for replacing one or more wearing parts, blocking fluid and a fragrance or cleaning substance used in a urinal device according to claim 9, wherein said biologically degradable cleaning substance is a sanitizing bacteria.

12. An apparatus for determining and fixing a time for replacing one or more wearing parts, blocking fluid and a fragrance or cleaning substance used in a urinal device, comprising:

an indicator element having an optically recognizable chemical or physical conversion indicator activated after a predetermined and set number of uses, or urine wettings, of a urinal device and not on the basis of continued proper functionality of said urinal device; and, a watertight, mushroom-shaped cap below which said indicator element is arranged for protecting a top portion and lateral portions of said indicator element from moisture, said indicator element being contactable by the urine wettings only upon a lower surface thereof with said indicator element dissolving upwardly from the lower surface until a sufficient mass of said indicator element is dissolved for providing a visibly recognizable color change through said watertight, mushroom-shaped cap, thereby indicating the time for replacing one or more wearing parts, blocking fluid and a fragrance or cleaning substance used in said urinal device.

13. The apparatus for determining and fixing a time for replacing one or more wearing parts, blocking fluid and a fragrance or cleaning substance used in a urinal device according to claim 12, wherein said mushroom-shaped cap comprises a plurality of feet for maintaining a lower side of said mushroom-shaped cap at a pre-determined distance from a discharge opening of said urinal device.

14. The apparatus for determining and fixing a time for replacing one or more wearing parts, blocking fluid and a fragrance or cleaning substance used in a urinal device according to claim 12, wherein said mushroom-shaped cap is made of a transparent plastic material.

15. The apparatus for determining and fixing a time for replacing one or more wearing parts, blocking fluid and a fragrance or cleaning substance used in a urinal device according to claim 12, wherein said indicator element and said mushroom-shaped cap together comprise a vertically running-through opening.

16. The apparatus for determining and fixing a time for replacing one or more wearing parts, blocking fluid and a fragrance or cleaning substance used in a urinal device according to claim 12, wherein said indicator element includes a paste settable in its degree of hardness.

17. The apparatus for determining and fixing a time for replacing one or more wearing parts, blocking fluid and a fragrance or cleaning substance used in a urinal device according to claim 12, wherein said indicator element includes a paste settable in its degree of decomposability.

18. The apparatus for determining and fixing a time for replacing one or more wearing parts, blocking fluid and a fragrance or cleaning substance used in a urinal device according to claim 12, wherein said indicator element includes a biologically degradable cleaning substance or dye for a use-dependent, self-activated cleaning of the urinal device.

19. The apparatus for determining and fixing a time for replacing one or more wearing parts, blocking fluid and a fragrance or cleaning substance used in a urinal device according to claim 18, wherein said biologically degradable cleaning substance is an enzyme.

20. The apparatus for determining and fixing a time for replacing one or more wearing parts, blocking fluid and a fragrance or cleaning substance used in a urinal device according to claim 18, wherein said biologically degradable cleaning substance is a sanitizing bacteria.

* * * * *